US006786640B2

(12) United States Patent
Schneider et al.

(10) Patent No.: US 6,786,640 B2
(45) Date of Patent: Sep. 7, 2004

(54) TAMPER EVIDENT SLIDER PACKAGE

(75) Inventors: John H. Schneider, Frankfort, IL (US); Charles Thorpe, Park Ridge, IL (US); Donald L. Crevier, Essex, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/947,875

(22) Filed: Sep. 6, 2001

(65) Prior Publication Data

US 2003/0044093 A1 Mar. 6, 2003

(51) Int. Cl.[7] ..... B65D 33/34

(52) U.S. Cl. ..... 383/5; 383/61.2; 383/64; 383/204; 383/210

(58) Field of Search ..... 383/5, 64, 66, 383/61.2, 204, 210; 493/213

(56) References Cited

U.S. PATENT DOCUMENTS 5,601,368 A * 2/1997 Bodolay et al. ..... 383/5
5,733,636 A * 3/1998 May ..... 428/200
5,806,984 A * 9/1998 Yeager ..... 383/204
6,273,607 B1 * 8/2001 Buchman ..... 383/5
6,290,390 B1 * 9/2001 Buchman ..... 383/5
6,290,391 B1 * 9/2001 Buchman ..... 383/5
6,347,885 B1 * 2/2002 Buchman ..... 383/5
6,409,384 B1 * 6/2002 Provan et al. ..... 383/5
6,461,043 B1 * 10/2002 Healy et al. ..... 383/204
6,467,956 B1 * 10/2002 Tilman et al. ..... 383/61.3
6,474,866 B2 * 11/2002 Buchman ..... 383/5
6,488,410 B2 * 12/2002 Schneider ..... 383/5
6,575,625 B2 * 6/2003 Cappel et al. ..... 383/5
2001/0005973 A1 * 7/2001 Schneider et al. ..... 383/64

* cited by examiner

*Primary Examiner*—Jes F. Pascua
(74) *Attorney, Agent, or Firm*—Pitney Hardin LLP

(57) ABSTRACT

The reclosable plastic bag is formed by opposing panels of web with four sides sealed. A zipper is sealed within the bag so that a first zipper profile is sealed to a first opposing panel and a second zipper profile is sealed to a second opposing panel. A slider engaging the zipper profiles in a closed position protrudes from an opening in at least one of the opposing panels and may be further secured in place by a label. The slider cannot be moved from the position wherein the zipper profiles are closed to the position wherein the zipper profiles are open prior to the user tearing a perforated or otherwise weakened line across the panels. When this tear is made, it is unmistakable and intuitive evidence that the bag may have been previously opened and depending upon the circumstances, possibly tampered.

17 Claims, 5 Drawing Sheets

TAMPER EVIDENT SLIDER PACKAGE

BACKGROUND OF THE INVENTION

1. Field of the Invention

The present invention pertains to a slider package which includes a tamper evident feature.

2. Description of the Prior Art

In the prior art, plastic bags which are manufactured and filled in a form fill and seal process are known. However, many of these plastic bags are not tamper evident. While tamper evident containers are known, these containers typically include complex configurations with complicated manufacturing techniques. This complexity, of course, adds to the price of the tamper evident containers.

U.S. Pat. No. 5,669,715 entitled "Tamper-Evident Reclosable Plastic Bag with Slider" issued on Sep. 23, 1997 to Dobreski et al. relates to a tamper-evident bag with a slider. However, improvement in many aspects, such as the ease and intuitiveness of the operation, is desired.

SUMMARY OF THE INVENTION

The invention provides a plastic bag or package, preferably manufactured by a form fill and seal apparatus wherein the zipper is initially covered by the web so as to block the motion of the slider and the slider protrudes from an aperture punched in one or both sides of the film. Optionally, the slider can be initially covered with label which must be torn to provide access to the slider. Perforations are formed on both sides of the web immediately outwardly adjacent from and parallel to the zipper. Therefore, in order to permit the slider to move from its initial position, the user tears the perforated portions thereby providing access to the bag and further providing immediate and unmistakable evidence that the package has been opened. In an alternative embodiment, the initial movement of the slider tears the perforated portions.

Alternatively, rather than providing an aperture through which the slider protrudes, a C-shaped slit with three sides can be formed in the web in place to act as a hinge, so that the resulting flap can be folded back to act as a pull tab for pulling off the strips adjacent to the slider, along the lines of weakened resistance.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1A:
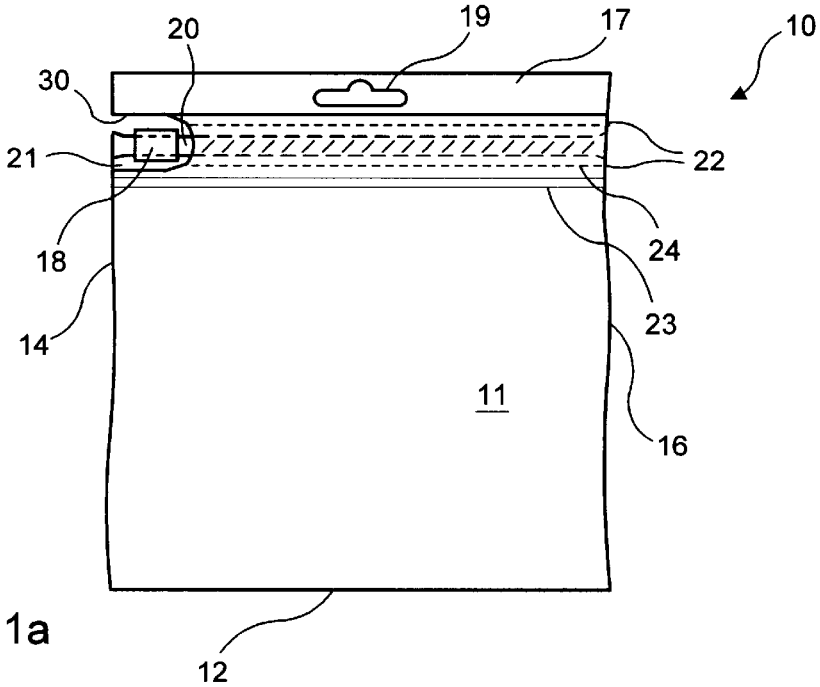
FIG. 1*a* is a plan view of a first embodiment of the package of the present invention, wherein the slider is initially located within a notch cut into the side of the package.

Referring now to the drawings in detail wherein like numerals indicate like elements throughout the several views, FIG. 1*a* is a first embodiment of plastic bag (or similar container) 10. Plastic bag 10 (or similar container) is formed from two sheets of web 11 which are joined at the edges by lower transverse seal 12 and side folds (or seams) 14, 16. Sheets of web 11 are further joined by a top transverse sealed header 17 which can further include optional hang aperture 19. Plastic bag 10 can include several different embodiments such as pillow pouches, three-side seal and bottom gusset pouches and side gusset pouches.

Slider 18 provides the ability to selectively open and close zipper profiles 20 which are sealed to the interior of the two sheets of web 11 by zipper profile flanges 21 at seal 23 downwardly adjacent from top transverse sealed header. However, zipper profiles 20 are initially closed and covered by the web 11 so as to prevent the movement of slider 18 prior to the user tearing web 11 (in an alternative embodiment, the initial movement of slider 18 can tear the web 11). Line 22 indicates the profile 20 as shown under the web 11. The sheets of web 11 include perforation 24 (or similar weakening of web 11) immediately below the opening of zipper profiles 20 80 that the user can tear web 11 along lines defined by perforation 24 thereby creating a mouth for plastic bag 10. However, zipper profiles flanges 21 must be sealed to web 11 below perforation 24 in order to allow plastic bag 10 to be resealable. Similarly, the tearing must be along defined lines in order for zipper profiles 20 to maintain their connection with the remaining portions of web 11 (that is, below perforation 24) in order to allow plastic bag 10 to be resealable. This tearing further provides immediate and clear evidence that bag 10 may have been opened by providing the tamper-evident characteristic. Slider 18 protrudes through notch 30 formed in web 11 along the side sealed by side fold (or seam) 14. Notch 30 directs the force of opening to a point along the perforation 24 thereby facilitating easy opening of the package. This further allows the user a simple and intuitive way to grasp slider 18 in the initial position. Notch 30 allows the consumer to see slider 18.

Figure 1B:
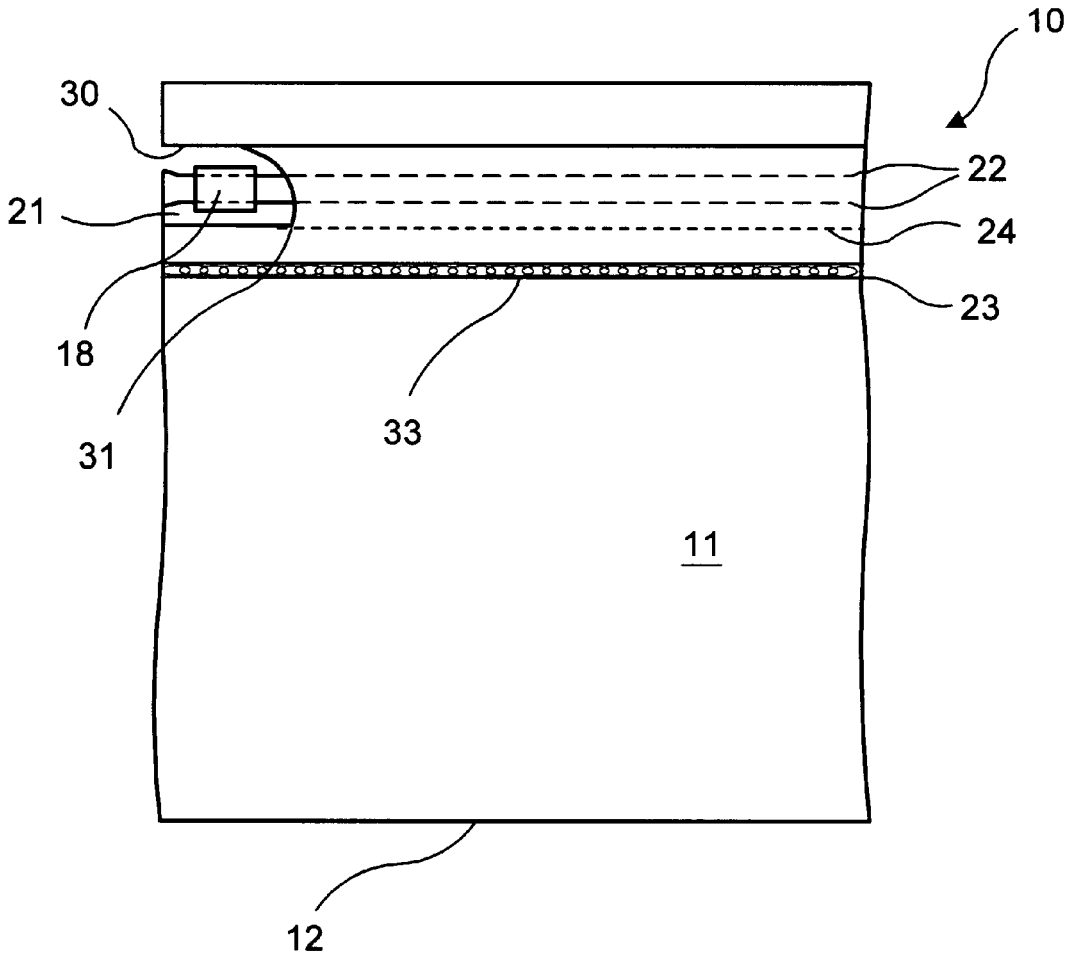
FIG. 1*b* is a plan view of a second embodiment of the package of the present invention, wherein the notch tapers toward the lower perforation. Additionally, a peel seal is formed within the package.

The second embodiment of plastic bag 10 is shown in FIG. 1*b*. Notch 30 is formed on the side of plastic bag 10. Notch 30 is similar to that shown in FIG. 1*a*. However, notch 30 tapers to point 31 which joins perforation 24 thereby more effectively directing the force of opening to perforation 24. Additionally, peel seal 33 is formed parallel to and downwardly adjacent from perforation 24 so as to join the interiors of both sheets of web 11.

Figure 5:
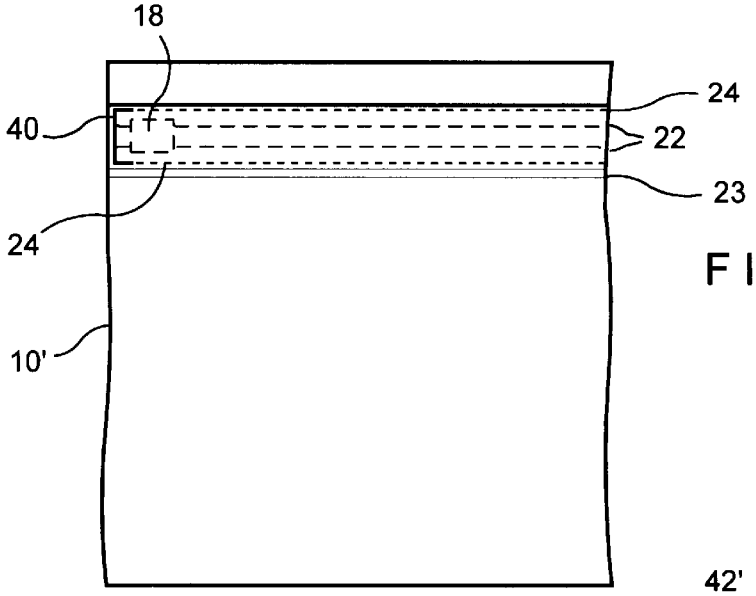
FIG. 5 is a plan view of a third embodiment of the present invention wherein the slider is initially located within a tab formed along the side of the package.
Figure 7:
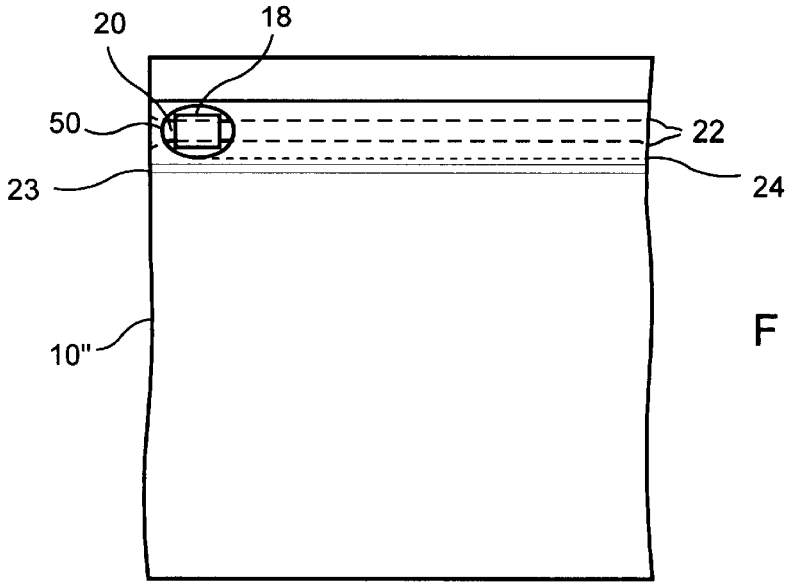
FIG. 7 is a plan view of a fourth embodiment of the present invention wherein the slider initially protrudes through an aperture punched or otherwise formed in the web of the package.

Further alternative embodiments are shown in FIGS. 5 and 7 wherein notch 30 is replaced by a flap 40 or an aperture 50, respectively. Slider 18, of course, can be returned to the position wherein zipper profiles 20 are sealed, but the tearing along perforation 24 clearly indicates prior opening or tampering.

Figure 2:
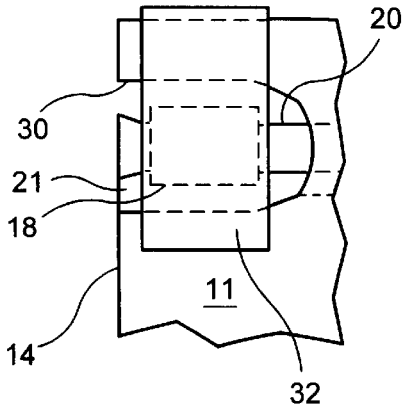
FIG. 2 is a plan view of a first aspect of a label covering the slider in the first embodiment of the package of the present invention.
Figure 3:
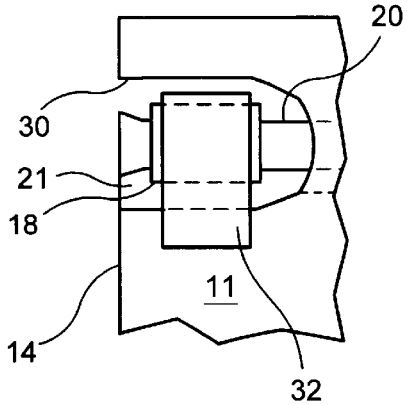
FIG. 3 is a plan view of a second aspect of a label covering the slider in the first embodiment of the package of the present invention.
Figure 4:
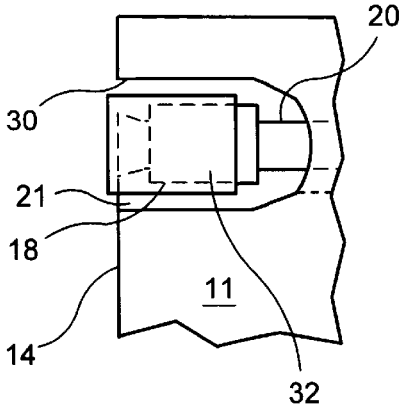
FIG. 4 is a plan view of a third aspect of a label covering the slider in the first embodiment of the package of the present invention.

In order to further enhance the tamper evident characteristic of plastic bag 10, as shown in FIGS. 2–4, label 32 can be glued or otherwise affixed to slider 18 in its initial position so that any movement of slider 18 will tear label 32. In FIG. 2, label 32 vertically spans notch 30 and is fastened to slider 18 and both the top and bottom of notch 30. In FIG. 3, label 32 is fastened to slider 18 and the bottom of notch 30. In FIG. 4, label 32 is fastened to slider 18 and zipper profiles 20.

FIG. 5 illustrates a third embodiment of plastic bag 10' wherein a flap 40 is formed rather than a notch 30.

Figure 6:
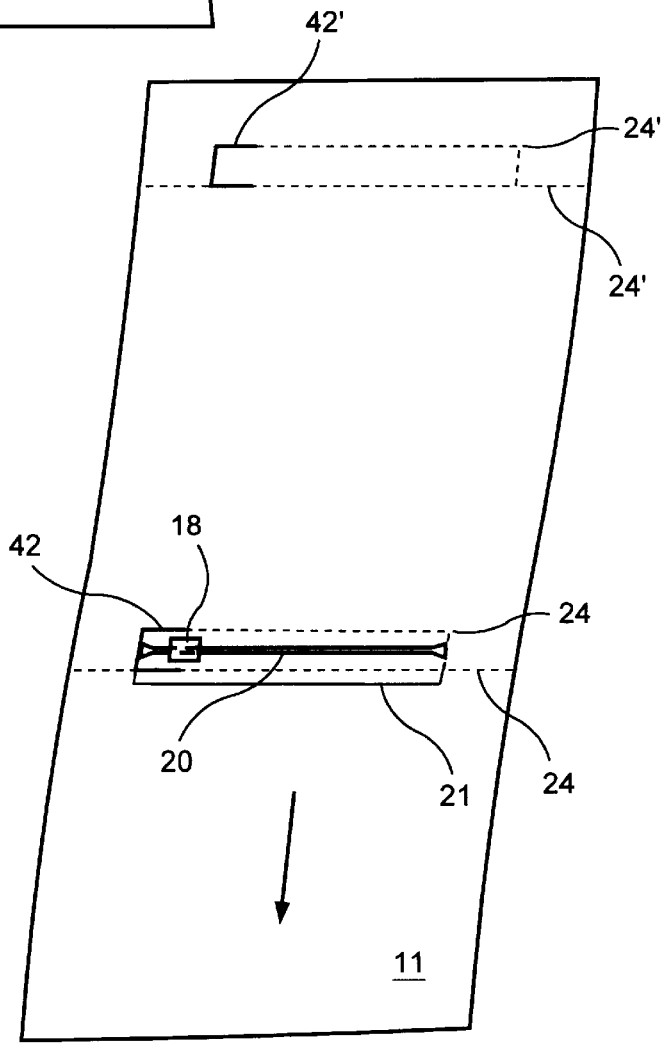
FIG. 6 is a plan view of the web prior to the formation of the second embodiment of the present invention.

FIG. 6 illustrates how web 11 is configured to form the third embodiment of plastic bag 10'. C-shaped cut 42 is formed so as to partially encircle slider 18 (C-shaped cut 42 would be a square or rectangular aperture in order to form notch 30 of the first embodiment of plastic bag 10 shown in FIG. 1, and a circular or formed aperture could likewise be substituted). Perforation 24 is formed across web 11. Sides of web 11 will eventually be folded over as shown in FIG. 5.

To illustrate the nature of how successive bags 10' are formed on web 11, C-shaped cut 42' and perforation 24' for a subsequent bag 10', prior to the sealing of slider 18 or zipper profiles 20 thereon, are shown upstream from the corresponding elements.

Figure 8:
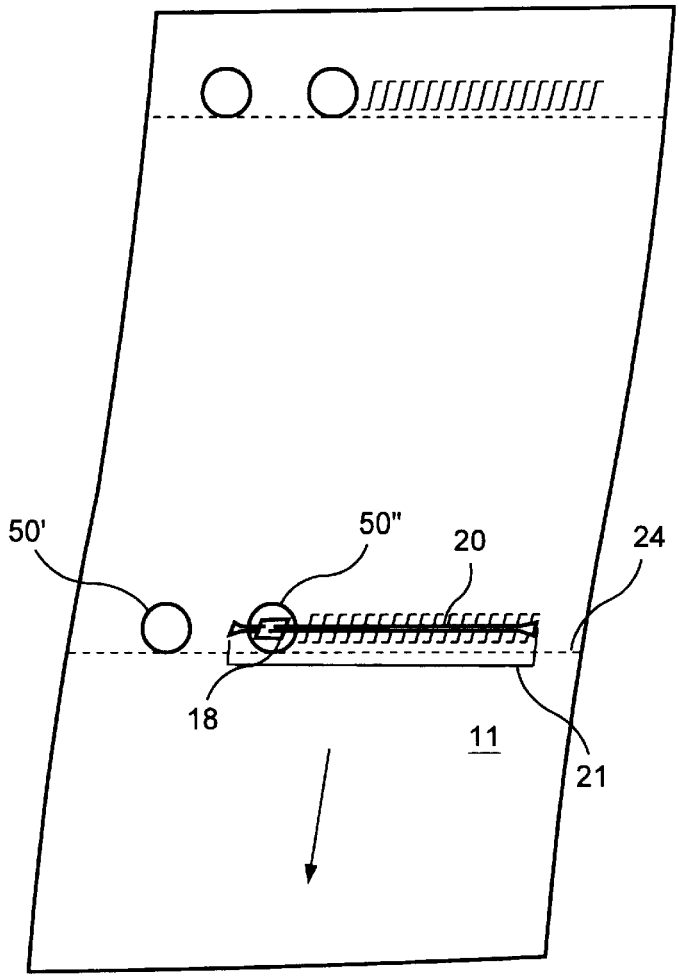
FIG. 8 is a plan view of the web prior to the formation of the fourth embodiment of the present invention.

FIG. 7 illustrates how aperture 50 may be formed through which slider 18 protrudes in the fourth embodiment of plastic bag 10". While FIG. 8 is illustrated with two immediately adjacent apertures 50' and 50" which could be folded over to form the single aperture 50 of FIG. 7, it is envisioned that only one of apertures 50', 50" would be formed thereby creating aperture 50 through a single layer of web through which slider 18 initially protrudes.

Figure 9:
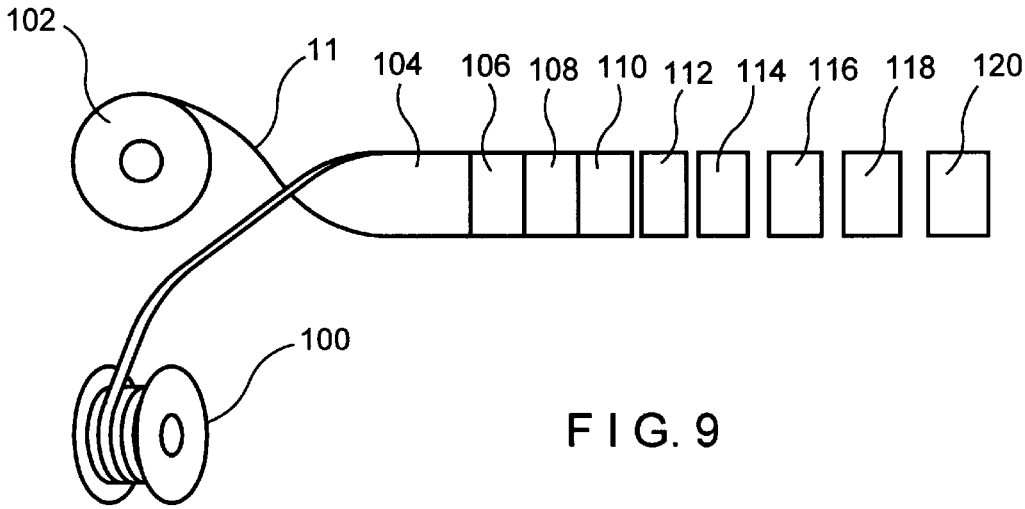
FIG. 9 is a schematic of a typical method of formation of the containers or bags of the present invention, using horizontal form, vertical fill and seal apparatus.

FIG. 9 illustrates the typical stations used to manufacture the various embodiments of plastic bag 10 in a horizontal form vertical fill and seal configuration. Spool 100 provides a succession of zipper profiles 20 with sliders 18. Spool 102 provides web (or film) 11 which may be pre-punched with one of the various shapes to form notch 30, flap 40 or aperture 50 or alternatively, these shapes along with perforation 24, may be formed prior to station 104 where zipper profiles 20 are sealed to web (or film) 11. Side seals (14, 16 or similar) are formed at station 106. Side seals cool at station 108 where slider 18 is moved to a position whereby the zipper profiles 20 are open or separated with respect to each other. The packages or bags 10 are cut from web or film 11 at station 110. The packages or bags 10 are filled at station 112. At station 114, the slider 18 is moved to a position whereby the zipper profiles 20 are closed or interengaged with respect to each other. Header seal 17 and lower tamper evident (hermetic) seal are formed at station 116. Label 32 and (optional) hang aperture are formed at station 118. Pick and place operations for packing are performed at station 120. Similar variations may fold the film before the punching operation is performed. Likewise, other variations may perform the shaping of the zipper profiles 20 and the insertion of the slider 18 as separate steps.

Figure 10:
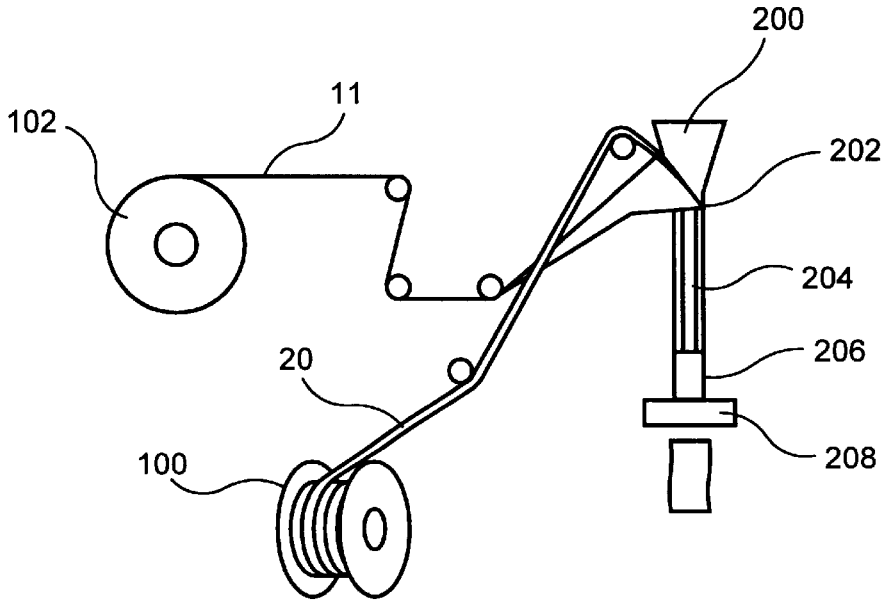
FIG. 10 is a schematic of a typical method of formation of the containers or bags of the present invention, using vertical form fill and seal apparatus.

FIG. 10 illustrates the typical stations used to manufacture the various embodiments of plastic bag 10 in a vertical form fill and seal configuration. Zipper profiles 20, with slider 18 in a closed position, are provided on spool 100 while pre-punched web 11 is provided on spool 102. Web 11 is wrapped around vertical form fill and seal (VFFS) apparatus 200 as is known in the prior art. Zipper profiles 20 are attached to web 11 and tamper evident seal and header seal 17 are formed at area 202 of VFFS apparatus 200. Optional hang aperture 19 and label 32 may be added at area 204 of VFFS apparatus 200. Bag 11 is manufactured in the inverted position so that the area which will form bottom transverse seal 12 is pointing upward so that the opening which will later be sealed by bottom transverse seal 12 can receive foodstuffs or similar contents at area 206. Bottom transverse seal 12 is formed and bag 10 is cut away from web 11 at area 208. Those skilled in the art, after study of the above, will recognize variations in the form fill and seal apparatus which may be implemented.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A bag which is tamper-evident, comprising:

first and second opposing panels attached to each other along a pair of sides, a top bridging said pair of sides and a bottom bridging said pair of sides;

a zipper with first and second profiles fastened to respective internal surfaces of said first and second opposing panels;

wherein at least one of said opposing panels includes a weakened portion adjacent to said zipper, and a cut portion proximate to said weakened portion; and a slider attached to said zipper to move from a first position within said cut portion wherein said first and second profiles are attached to each other, and to a second position wherein at least a portion of said first and second profiles are detached from each other, said slider initially being in said first position and wherein prior movement of said slider toward said second position is evidenced by tearing of at least a portion of said weakened portion thereby forming a mouth for the bag, wherein said slider is further initially engaged in said first position by a label.

2. The bag of claim 1 wherein a user tears at least a portion of one of said opposing panels in order to permit said slider to move from said first position to said second position.

3. The bag of claim 2 wherein said weakened portion is formed by perforation.

4. The bag of claim 3 wherein said cut portion is an aperture formed in one of said opposing panels which is spaced from said pair of sides.

5. The bag of claim 3 wherein said cut portion is a notch which forms a flap engaging said slider and a pair of perforations extending parallel from said flap.

6. The bag of claim 3 wherein said cut portion is a notch formed by removing material from at least one pair of sides.

7. The bag of claim 1 wherein initial movement of said slider from said first position to said second position tears at least one of said opposing panels.

8. The bag of claim 1 wherein said mouth formed in at least one of said panels further includes said zipper in an at least partially open position.

9. The bag of claim 1 wherein said slider is further initially engaged by said label to protrude from said cut portion.

10. The bag of claim 1 wherein the bag is formed by a form fill and seal apparatus.

11. The bag of claim 10 wherein said opposing panels are formed by a single roll of web.

12. The bag of claim 11 wherein said cut portions are formed in said web prior to providing said web to the form fill and seal apparatus.

13. The bag of claim 11 wherein said cut portions are formed in said web by the form fill and seal apparatus.

14. The bag of claim 1 wherein said cut portion tapers so as to be directed toward said weakened portion.

15. The bag of claim 1 wherein said cut portion is formed on both said first and second opposing panels.

16. The bag of claim 1 further including a peel seal downwardly adjacent and parallel to said weakened portion thereby forming a peel seal relationship between interiors of said opposing panels.

17. A tamper-evident zipper assembly used to open a mouth, the zipper assembly comprising:

a zipper having a first profile and a second profile, the first profile being fastened to a first panel and the second profile being fastened to a second panel; and a slider attached to the zipper to move from a first position wherein said first and second profiles are attached to each other, and to a second position wherein at least a portion of the first and second profiles are detached from each other, the slider initially being in the first position and protruding from an opening in one of the panels and wherein prior movement of said slider toward said second position is evidenced by tearing of at least a portion of one of said opposing panels thereby forming a mouth and said slider is engaged in said first position by a label.

* * * * *